United States Patent [19]

Nakae et al.

[11] Patent Number: 4,811,521

[45] Date of Patent: Mar. 14, 1989

[54] TRUING DEVICE FOR HONES

[75] Inventors: Yoshio Nakae; Akiyo Kinoshita; Koichi Tanaka, all of Kyoto, Japan

[73] Assignee: Kabushiki Kaisha Nisshin Seisakusho, Nakagun, Japan

[21] Appl. No.: 113,162

[22] Filed: Oct. 27, 1987

[30] Foreign Application Priority Data

Nov. 5, 1986 [JP] Japan ..... 61-170581[U]
Nov. 5, 1986 [JP] Japan ..... 61-170582[U]

[51] Int. Cl.[4] ..... B24B 5/00

[52] U.S. Cl. ..... 51/5 D; 51/325; 51/262 T; 125/11 DG

[58] Field of Search ..... 51/5 D, 73 R, 325, 262 T; 125/11 DG

[56] References Cited

U.S. PATENT DOCUMENTS 1,086,698 2/1914 Baulig ..... 51/73 R
4,112,624 9/1978 Uhtenwoldt et al. ..... 51/5 D
4,718,196 1/1988 Seewald ..... 51/5 D

*Primary Examiner*—Frederick R. Schmidt
*Assistant Examiner*—Robert Rose
*Attorney, Agent, or Firm*—Mason, Fenwick & Lawrence

[57] ABSTRACT

A truing device that can form surfaces of hones, installed in a honing tool, into R-shapes (i.e. provided with rounded off edges or corners) with the same diameter as that of the honing tool or plane shapes. A truing tool is provided with a penetrating hole through which the honing tool is inserted and at least a part of an inner surface of the penetrating hole is a cylindrical surface having the same diameter as that of the honing tool and at least a part of said penetrating hole inner surface is provided with cutting edges for hone grinding. A tool holder housing the truing tool attachably and removably is held in a jig body of a tool holding device in a manner that the tool holder can shake within a range of three dimensional minute angles, thereby allowing said truing tool to smoothly follow movement of said honing tool during truing.

8 Claims, 5 Drawing Sheets

TRUING DEVICE FOR HONES

FIELD OF THE INVENTION

This invention relates to a truing device for hones use in a honing base and, more particularly, to the truing device that can form surfaces of hones, installed in a honing tool, into R-shapes (i.e. provided with rounded off edges or corners) with the same diameter as that of the honing tool or plane shapes.

DESCRIPTION OF THE PRIOR ART

In general, when a honing tool is used attaching borazon hones or diamond hones to hone bases of the honing tool, in many cases each hone does not have a suitable surface shape or dimension for an inner surface of an object to be honed because of strain caused by workings.

Therefore, prior to setting the honing tool in the honing base, truing working is performed which forms each hone, attached to the hone base, into a predetermined shape or dimension by a truing machine.

Now, in conventional truing working for a honing tool having a plurality of hones, namely, a multi-hone honing tool, the truing was carried out in such a manner that a plurality of hones of the honing tool were installed into other tool heads equipped to a truing machine and were subjected to truing by a cylindrical grinding method by using a truing tool.

Further, in a so-called one hone honing tool equipped with one hone and a plurality of guide pieces, only one hone was fixed to the above-mentioned tool head and subjected to truing.

However, these conventional methods had the following problems.

That is, in the former, when a plurality of hones subjected to truing are installed into a honing tool being actually used, R-shapes having the same diameter as that of actual honing or plane shapes can not be obtained because of the difference in working accuracy between the honing tool and the tool head, whereby the accuracy of the honing in the honing base varies and does not stabilize. The term "R-shapes" as herein used refers to rounded shapes or circular arc shapes with a radius, the giving of "R-shape" to work meaning to round off its edges or corners.

In the latter, it is difficult to fix the hone tool head and so the truing is also very difficult to work with a machine, therefore, this working must be performed using minium to detect touch by manual handling. Accordingly, the truing working not only requires much trouble but also does not stabilize truing accuracy of a hone and results in bad honing accuracy on a honing base.

Furthermore, the truing tools of the above-mentioned truing machine are all so designed that they are fixed to their tool holding devices and can not be transferred. Therefore, even if the R-shape with the same diameter as that of honing or the plane shape can be formed on the truing tool, a surface of a hone can not be properly formed when axes of the tool head and the truing tool are slightly shifted or inclined with respect to each other.

BRIEF SUMMARY OF THE INVENTION

In view of these conventional problems, this invention has been made and, therefore, it is a principal object of the present invention to provide a novel truing device for hones which can solve the problems.

It is a further object of the invention to provide a truing device for hones which effectively provides a hone or a plurality of hones, attached to the honing tool, with R-shapes having the same diameter as that of the actual honing tools or plane shapes, thereby stabilizing accuracy of truing and greatly improving accuracy of honing working at the beginning of hone exchange.

It is a further object of the invention to provide a truing device for hones which provides a tool holder means of a tool holding device with three dimensional free movement relative to a jig body, thereby allowing a truing tool, installed in the tool holder means, to smoothly follow movement of a honing tool.

A truing device for hones according to the present invention is comprised of a truing tool provided with a penetrating hole through which a honing tool is inserted, and a tool holding device that holds the truing tool. The truing tool is provided with a penetrating hole for insertion of the honing tool, and at least a part of an inner surface of the penetrating hole is a cylindrical surface having the same diameter as that of the honing tool, and at least a part of said penetrating hole inner surface is provided with cutting edges for hone grinding, a tool holder means is held in a jig body of said tool holding device in a manner that the tool holder means can shake within a range of three dimensional minute angles, and the tool holder means is provided with a recessed insertion hole, in which said truing tool is attachably and removably housed, thereby allowing said truing tool to smoothly follow movement of said honing tool during truing working.

The foregoing and other objects and features of the above-mentioned invention will become apparent by reading the following detailed description based on the accompanying drawings and novel items pointed out in the claims.

DETAILED DESCRIPTION OF THE PREFERRED EMBODIMENT

Embodiment 1

Figure 1:
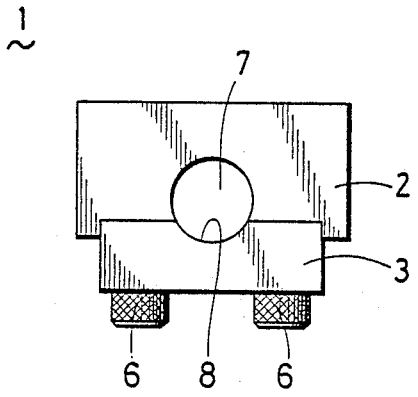
FIG. 1 is a plan view showing a truing tool of a truing device for a one-hone honing tool according to embodiment 1 of the invention.
Figure 2:
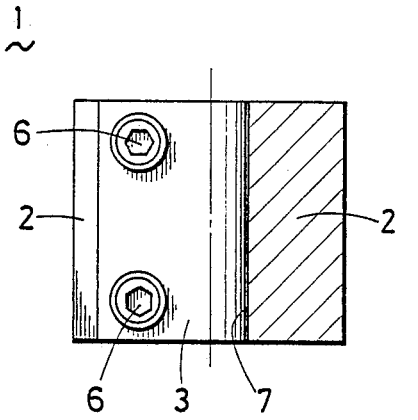
FIG. 2 is a front view showing the truing tool having the right side half sectioned.

FIGS. 1 and 2 show a truing tool of a truing device A for a hone in accordance with the present invention.

Figure 4:
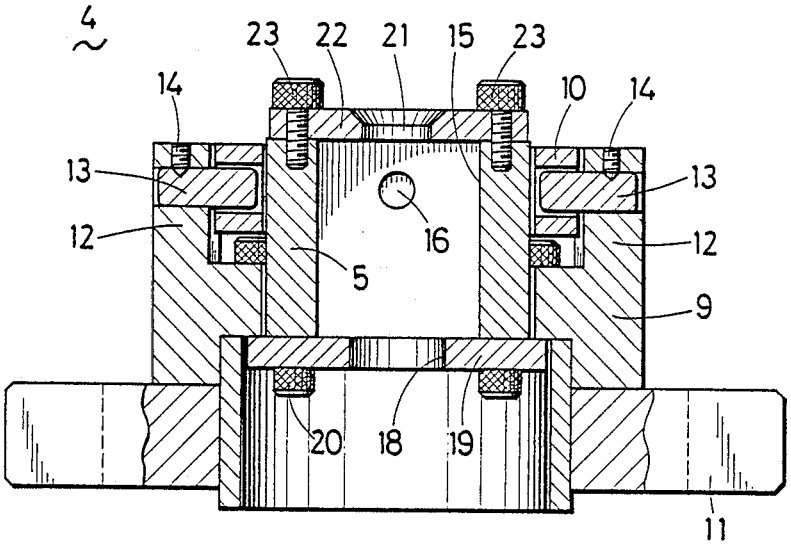
FIG. 4 is a longitudinal sectional view of the tool holding device.
Figure 5:
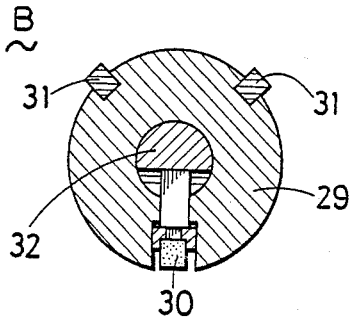
FIG. 5 is a lateral sectional view showing a mandrel portion of a one-hone honing tool.

The truing tool 1 is used for truing of a one-hone honing tool B as embodied in FIG. 5 and is comprised of a guide member 2 and a grinding member 3. These members being housed in a tool holder 5 of a tool holding device 4 of FIGS. 3, 4 constitute the above-mentioned truing device A. As shown in FIG. 5, a mandrel portion 29 of the one-hone honing tool B is provided with one hone 30 and two guide pieces 31, 31. The hone 30 can be radially moved forward or backward by a cone rod 32.

The grinding member 3 is attached to the guide member 2 by a plurality of bolts 6. The guide member 2 and the grinding member 3 are provided with a penetrating hole 7. This hole 7 is so made that it extends over the guide member 2 and grinding member 3 and has the same inner diameter as a honing working diameter of the one-hone honing tool B. The penetrating hole 7, as shown in a sectional view of FIG. 1, is formed in a circular arc section having more than a semicircle in the guide member 2, while in a circular arc section having less than a semicircle in the grinding member 3.

Figure 3:
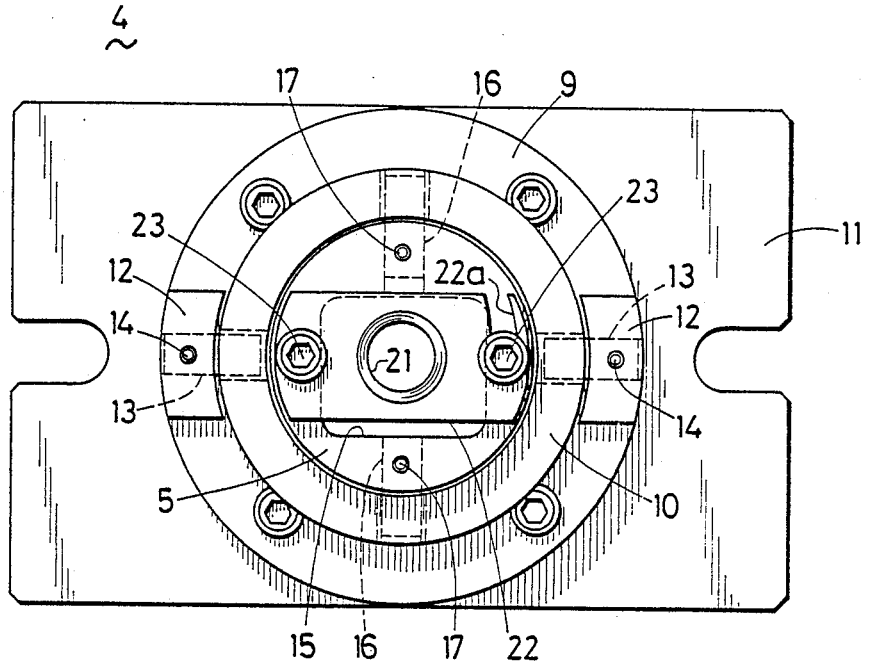
FIG. 3 is a plan view showing a tool holding device for holding the truing tool.

The cylindrical inner surface of the penetrating hole 7 formed in the grinding member 3 is provided all over the surface with cutting edges 8 such as diamond edges or edges having the same sharpness, which are used to provide an R-shape formation on the hone 30 of the honing tool B. As shown in FIGS. 3 and 4, the tool holding device 4 holding the truing tool 1 is provided with a jig body 9, an annular intermediate ring 10 and the tool holder 5 as main members, and a tool holder means is comprised of the tool holder 5 and the intermediate ring 10.

The jig body 9 is formed in a cylindrical shape and a lower portion of it is fixed to a jig base 11. At opposite positions on one diameter of an upper portion of the jig body 9 are provided a pair of upward projected holding portions 12, 12, that is, ring holding portions.

Inside these projected holding portions 12, 12, the intermediate ring 10 is held by a pair of first supporting pins 13, 13.

Each first supporting pin 13, 13 is fixed to the projected holding portion 12, 12 by each fixing screw 14, 14.

The intermediate ring 10 is so designed that its outer diameter is slightly smaller than a distance between the projected holding portions 12, 12, that is, an inner diameter of a cylinder forming an inner surface of the projected holding portions 12, 12. Therefore, there is a slight clearance between the projected holding portions 12, 12 and the intermediate ring 10. This allows the intermediate ring 10 not only to shake a little around the first supporting pins 13, 13 but also to move a little in the axial directions of the first supporting pins 13, 13 according to the size of the clearance.

In addition, an inside of the intermediate ring 10 is provided with a rectangular recessed insertion hole 15 in which the truing tool 1 is tightly inserted and housed. The tool holder 5, a part of which is inserted into the jig body 9, is supported by a pair of second supporting pins 16, 16 on another diameter intersecting at right angle with said one diameter. A portion 17 is a screw which fixes the second supporting pins 16, 16 to the tool holder 5.

Further, the tool holder 5 has an outer surface of a cylinder having a little smaller outer diameter than the inner diameter of the intermediate ring 10. Therefore, there is a slight clearance between the intermediate ring 10 and the tool holder 5. This allows the tool holder 5 not only to shake a little around the second supporting pins 16, 16 but also to move a little in the axial directions of the second supporting pins 16, 16.

A lower end surface of the tool holder 5 is provided with a bottom plate 19 which is fixed with screws 20, 20 as shown in FIG. 4. A center portion of the bottom plate 19 is provide with a penetrating hole 18 through which the honing tool B can be penetrated.

The tool holder 5 may be so designed that it is provided with a recessed hole whose bottom is closed and then a circular hole is formed in a center of the bottom rather than fixing the bottom plate 19, having the penetrating hole 18, to the tool holder 5.

On the other hand, a pushing member 22 is attachably and removably fixed to an upper surface of the tool holder 5 with screws 23, 23. A center of the pushing member 22 is provided with a circular opening 21 to penetrate the honing tool B. This pushing member 22 serves to prevent the truing tool 1, housed in the tool holder 5, from being released out of an upper portion of the tool holder 5 during truing working. This pushing member 22 is provided with an arcuate broken-off portion 22*a* centered at one of the screws 23 and extending from one side of the pushing member 22 to the other screw 23. This broken-off portion 22*a* facilitates opening and closing the recessed insertion hole 15 of the tool holder 5 by rotating the pushing member 22 around one screw 23 when the screws 23, 23 are only slightly loosened.

Figure 6:
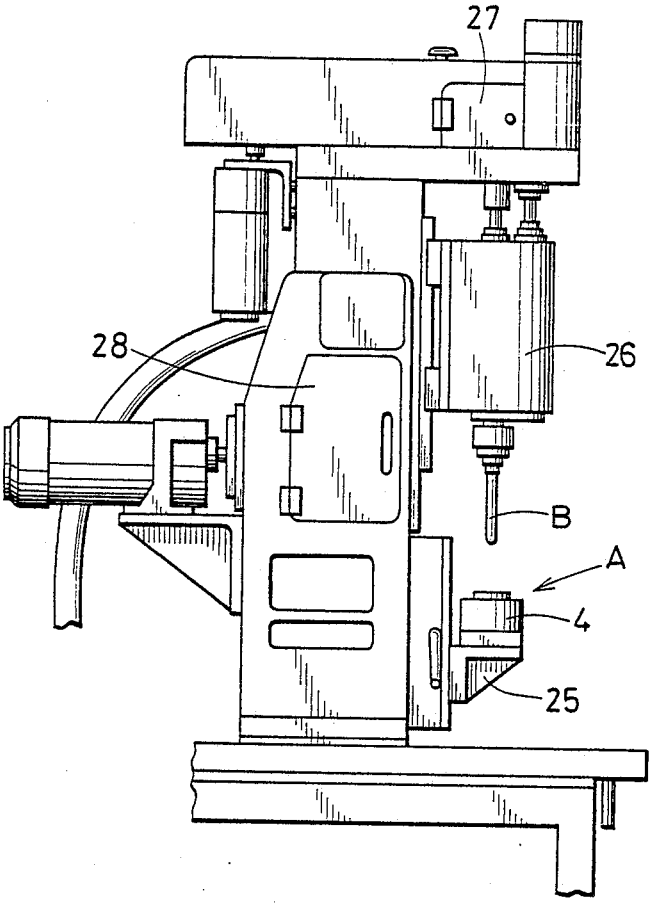
FIG. 6 is a side view of a truing machine installing a truing device.

The truing device A comprised of the truing tool 1 and the tool holding device 4 can be installed in a special truing machine by means of a bracket 25 as shown in FIG. 6 and also it may be attachably and removably installed in a honing base, not illustrated in a figure.

The above-mentioned truing machine is provided with the followings as main portions: a slide body 26 which maintains actual operating condition of the honing tool B, a shake-rotation switching mechanism 27 which selectively gives the honing tool B rotation or shaking, oscillation and hone extension and a stroke adjusting mechanism 28 which adjusts a stroke of upward or downward movement of the honing tool B.

Now, a description of the truing working is given below when the truing device A is installed in the truing machine of FIG. 6.

① Installation of truing tool and honing tool:

In the truing machine, remove the pushing member 22 of the tool holding device 4 and house the truing tool 1 in the recessed insertion hole 15 of the tool holder 5 so that the axis of the penetrating hole 7 becomes vertical, and then attach the pushing member 22 again.

Then install the honing tool B in the slide body 26.

② Start of truing machine:

Set truing machine operating conditions for shake and oscillation mode of the honing tool B by operating the shake-rotation switching mechanism 27 and the stroke adjusting mechanism 28 and start the truing machine.

Then, the honing tool B is inserted into the penetrating hole 7 of the truing tool 1 through the circular opening 21 of the pushing member 22, and the hone 30 and the guide pieces 31, 31 of the honing tool B are pressed against the penetration hole 7 inner surface by hone expansion action. That is, the hone 30 touches cutting edges 8 of the grinding member 3 on the hole 7 cylinder surface, and simultaneously the guide pieces 31, 31 touch the cylinder inner surface of the guide member 2.

Then the honing tool B performs movement preset as above-mentioned, whereby the peripheral surface of the hone 30 is pressed against the cutting edges 8 and formed into the R-shape having the same diameter as the honing tool.

And simultaneously, being provided with the second supporting pins 16, 16 and the first supporting pins 13, 13, the tool holder 5 of the tool holding device 4 can move in the axial direction of these supporting pins and shake around these supporting pins, thereby providing the truing tool 1, installed in the tool holder 5, with three dimensional free movement.

As a result, even if the axis of the tool holding device 4 or the truing tool 1 and the axis of the honing tool B are slightly shifted or inclined relative to each other and therefore the honing tool B touches the pushing member 22 or the truing tool 1, the truing tool 1 can smoothly follow movement of the honing tool B.

Therefore, when the truing device of this embodiment is used, it can employ the honing tool B as it is which is being used for actual honing and perform truing of hone 30. Thus, a special fixing method for hone 30 is not necessary during truing working and the working with high accuracy can be efficiently performed. Further, accuracy of honing working can also be improved when hones are exchanged.

Furthermore, because the R-shape formation on the hones 30 installed in the honing tool B is effected by using the truing tool 1 having the same diameter as that of the honing tool, modification of the hones 30 after the honing tool B is fixed to its base is completely unnecessary and honing with high accuracy can be effected with the honing tool B as it is.

In this case, because the intermediate ring 10 and the tool holder 5 can move horizontally in two axial directions which intersect at right angles and can make pendulum motion around their supporting axes 13, 13, 16, 16, the tool holding device 4 holding the truing tool 1 provides the truing tool 1, held in the tool holder 5, with free movement that smoothly follows movement of the honing tool B, thereby effecting highly accurate truing.

Embodiment 2

Figure 7:
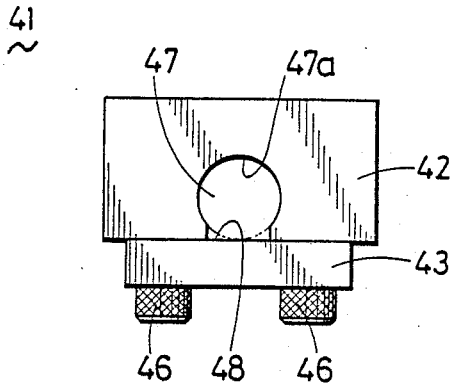
FIG. 7 is a plan view showing a truing tool for a one-hone honing tool according to embodiment 2 of the invention and corresponds to FIG. 1.
Figure 8:
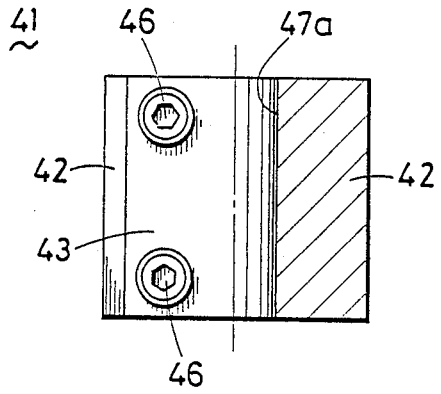
FIG. 8 is a front view showing the truing tool having the right side half sectioned and corresponds to FIG. 2.

Embodiment 2 is illustrated in FIGS. 7 and 8, in which the truing tool of the truing device A of embodiment 1 is somewhat modified.

That is, a truing tool 41, as in the case of embodiment 1, is used for truing of a one hone honing tool and is comprised of a guide member 42 and a grinding member 43, and the grinding member 43 is attached to the guide member 42 with bolts 46, as in the case of embodiment 1 illustrated in FIGS. 1 and 2.

As shown in FIG. 7, a penetrating hole 47 of the truing tool 41 is comprised of a combination of a cylindrical surface and a plane whose horizontal sectional view has a circular arc more than a semicircle and a straight line tangential to a prolonged portion of the circular arc.

That is, a cylindrical guide surface 47*a* is formed in the guide member 42 and a plane is formed in the guiding member 43. This plane is provided with diamond cutting edges or edges 48 having the same sharpness. The plane to be equipped with the cutting edges 48 is tangential to an assumed cylindrical surface portion i e. the prolonged portion of the cylindrical guide surface 47*a*. and the plane and the cylindrical guide surface are connected via two parallel planes at right angles to the surface of the grinding member 43.

The structure of the tool holding device 4 which holds the truing tool 41 is the same as that illustrated in FIGS. 3 and 4.

Figure 9:
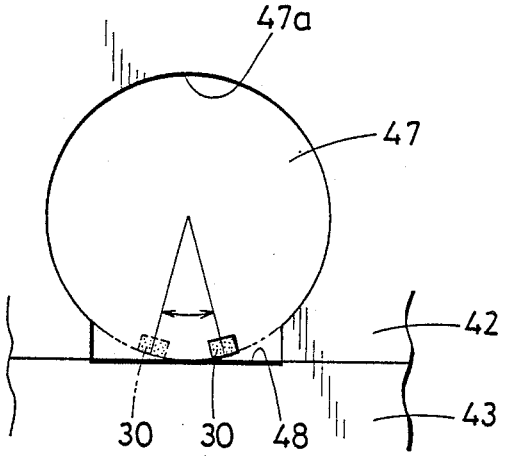
FIG. 9 is an enlarged view of a main portion that performs an R-shape truing on a surface of a hone of a one-hone honing tool by using the truing tool shown in FIGS. 7 and 8.

Installation of the truing device A of embodiment 2 into the truing machine of FIG. 6 provides the honing tool B with shaking, oscillation and hone extension action. Then, as shown in FIG. 9, the hone 30 of the honing tool B is scrubbed with the cutting edge 48 of the truing tool 41 and is subjected to truing on its peripheral surface in the R-shape having the same diameter as that of the honing tool.

Giving only the oscillation and the hone expansion action to the honing tool B, the hone 30 is subjected to the plane shape truing which is used for key groove honing. Other structures and functions are the same as those of the embodiment 1.

Embodiment 3

Figure 10:
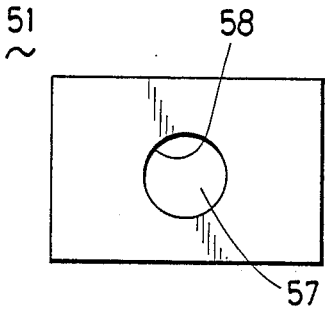
FIG. 10 is a plan view showing a truing tool for a multi-hone honing tool according to embodiment 3 of the invention and corresponds to FIG. 1.
Figure 11:
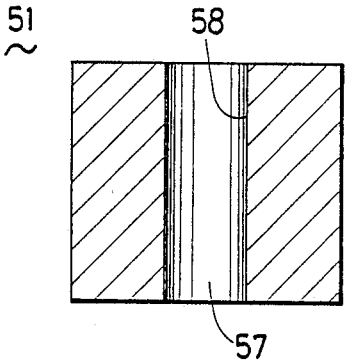
FIG. 11 is a longitudinal sectional view of the truing tool.

Embodiment 3 is illustrated in FIGS. 10 and 11, in which the truing tool of the truing device A of embodiment 1 is modified as in the case of embodiment 2.

Figure 12:
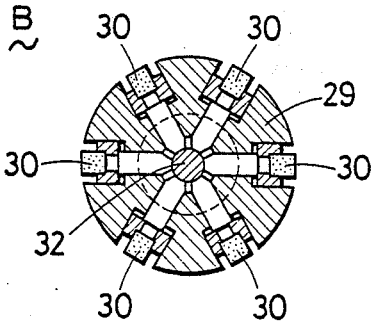
FIG. 12 is a lateral sectional view showing a mandrel portion of a multi-hone honing tool.

That is, a truing tool 51 is used for truing of a multi-hone honing tool B as shown in FIG. 12, and is formed into an integral structure different from those of embodiments 1 and 2.

Further, a penetrating hole 57 in the truing tool 51 has a cylindrical inner surface with the same diameter as that of the honing tool B and is provided, on the whole surface, with diamond edges or edges 58 having the same sharpness.

The multi-hone honing tool B is provided with a plurality of hones 30 (in the illustrated case, 6 pieces) on a mandrel 29. The hones 30 can be shifted radially forward and backward by the cone rod 32.

The structure of a tool holding device 4 that holds the truing tool 51 is the same as that illustrated in FIGS. 3 and 4.

Installation of the truing device A of the embodiment 3 into the truing machine of FIG. 6 provides the honing tool B with rotation, oscillation and hone extension action. Then, the hones 30 of the honing tool B are scrubbed with the cutting edges 58 of the truing tool 51 and subjected to truing on its peripheral surface in the R-shape having the same diameter as that of honing working.

Other structures and functions are the same as of embodiment 1.

According to the present invention, as described above in detail, the following superior effects can be obtained and excellent truing devices can be provided which can form on surfaces of hones, installed in a honing tool, the R-shape having the same diameter as that of the honing tool and the plane shape.

(a) Because a tool body is provided with a penetrating hole that penetrates a honing tool in a state in which it is actually used on a honing base, whether for a multi-hone honing tool or for a one-hone honing tool, truing can be performed in a state in which hones are installed in an actually used honing tool on the honing base or the truing machine.

(b) Because a tool holder means is held by a jig body of the tool holding device in a manner that the means can shake within a range of three dimensional minute angles, this enables the truing tool, installed in the tool holder means, to smoothly follow movement of the honing tool.

(c) Because truing is mechanically performed by the truing machine or the honing base, working is easy and quickly performed and efficiency of working is greatly improved.

Further, truing accuracy can be stabilized and also honing working accuracy can be improved at the beginning of hone exchange, therefore, honing working accuracy on the honing base can be stabilized.

Practical embodiments described in the "DETAILED DESCRIPTION" are primarily for the purpose of clarifying the technology of this invention, therefore, this invention should not be narrowly understood so as to limit it to the foregoing embodiments but should be widely understood so as to embody many variations within the true spirit and scope of the invention.

What is claimed is:

1. A truing device for hones comprising a truing tool and a tool holding device for holding the truing tool, said truing tool being provided with a hole to insert a honing tool, at least a part of an inner peripheral surface of the hole being a cylindrical surface having the same diameter as that of the honing tool, at least a part of said hole inner peripheral surface being provided with cutting edges for grinding hones, a tool holder means being shakably held by a jig body of said tool holding device within a range of three dimensional minute angles, the tool holder means being provided with a recessed insertion hole, said truing tool being attachably and removably housed in the recessed insertion hole, whereby said truing tool can smoothly follow movement of said honing tool during truing working.

2. A truing device for hones according to claim 1, wherein the hole inner peripheral surface of said truing tool is a cylindrical surface having the same diameter as that of the honing tool and a part of the cylindrical surface is provided with said cutting edges.

3. A truing device for hones according to claim 1, wherein the hole inner peripheral surface of said truing tool comprises a combination of a part of the cylindrical surface having the same diameter as that of the honing tool and a plane tangential to a circular arc section of the cylindrical surface, and the plane portion of the hole the honing tool is provided with said cutting edges.

4. A truing device for hones according to claim 1, wherein the hole inner peripheral surface of said truing tool is a cylindrical surface having the same diameter as that of the honing tool and a whole of the cylindrical surface is provided with said cutting edges.

5. A truing device for hones according to claim 2 or 3, wherein said truing tool has a divisible structure comprised of a grinding member and a guide member, said hole of said trueing tool is provided so as to cover the guide member and the grinding member, and a portion of the hole of said truing tool on the side of the grinding member is provided with said cutting edges, 6. A truing device for hones according to claim 1, wherein said jig body is provided with a cylinder portion and a pair of ring holding portions at symmetrical positions on one diametrical line of the cylinder portion, said tool holder means is comprised of an annular intermediate ring and a tool holder, the intermediate ring is so designed that its outer diameter is slightly smaller than a distance between said pair of ring holding portions and symmetrical portions on one diameter of the ring are each supported at said ring holding portions by first supporting pins, whereby said intermediate ring can shake around an axis of the first supporting pins within a range of minute angles and can move by minute distances in axial direction of the first supporting pins, said tool holder has a cylindrical peripheral surface having a slightly smaller diameter than the inner diameter of said intermediate ring and symmetrical portions on a diameter intersecting at right angles with the axis of said first supporting pins are each supported at two positions of the intermediate ring by second supporting pins, whereby said tool holder can shake around an axis of the second supporting pins within a range of minute angles and can move by minute distances axially of the second supporting pins, the tool holder is provided with said recessed insertion hole so that the axis of said intersection hole coincides with the axis of the cylinder portion of said jig body, and said truing tool is attachably and removably inserted and housed in the recessed insertion hole so that both the axes of said insertion hole and said cylinder portion coincide with each other.

7. A truing device for hones according to claim 6, wherein said ring holding portions of said jig body are upwardly projected holding portions which are provided in an erected state.

8. A truing device for hones according to claim 6, wherein upper and lower portions of the insertion hole of said tool holder are closed by a pushing member and a bottom plate member respectively and center portions of the pushing member and the bottom plate member are provided with an opening for insertion of the honing tool.

* * * * *